US005295752A

United States Patent [19]

Kawamoto et al.

[11] Patent Number: 5,295,752

[45] Date of Patent: Mar. 22, 1994

[54] PRINTER USING DOUBLE SHEETS OF PRESSURE SENSITIVE PAPER

[75] Inventors: Shinsuke Kawamoto, Ikoma; Osamu Miyajima, Yamatokouriyama; Tetsuya Ueda, Nabari, all of Japan

[73] Assignee: Sharp Kabushiki Kaisha, Osaka, Japan

[21] Appl. No.: 904,755

[22] Filed: Jun. 26, 1992

[30] Foreign Application Priority Data

Jun. 28, 1991 [JP] Japan ..... 3-158571

[51] Int. Cl.[5] ..... B41J 15/04

[52] U.S. Cl. ..... 400/606; 400/642

[58] Field of Search ..... 400/606, 248.1, 42, 400/642, 645, 605, 619, 586, 607, 587, 590, 592, 594, 594.1; 235/2, 3, 483, 60.23

[56] References Cited

U.S. PATENT DOCUMENTS

| | | | |
|---|---|---|---|
| 1,065,970 | 7/1913 | Seib | 400/644 |
| 2,331,331 | 12/1940 | Lambert | 400/606 |
| 2,351,075 | 4/1942 | Schultz | 400/606 |
| 3,107,836 | 10/1962 | Van't Veld | 400/642 |
| 3,653,483 | 4/1972 | Cortona et al. | 400/585 |
| 3,966,037 | 6/1976 | Zambolin | 400/585 |
| 4,276,598 | 6/1981 | Inoue | 235/3 |
| 4,655,626 | 4/1987 | Okazaki | 400/605 |
| 5,080,513 | 1/1992 | Clary | 400/591 |

FOREIGN PATENT DOCUMENTS

| | | | |
|---|---|---|---|
| 2812482 | 9/1979 | Fed. Rep. of Germany | 400/605 |
| 58-50093 | 3/1983 | Japan . | |
| 62-203053 | 8/1988 | Japan . | |
| 1-120284 | 8/1989 | Japan . | |
| 0745757 | 8/1953 | United Kingdom | 400/642 |

*Primary Examiner*—Edgar S. Burr
*Assistant Examiner*—Anthony H. Nguyen
*Attorney, Agent, or Firm*—David G. Conlin; George W. Neuner

[57] ABSTRACT

A printer using double sheets of pressure sensitive paper includes a casing having an opening at its upper portion, a paper guide disposed in the opening of the casing, and a paper support disposed under the opening of the casing. The paper guide separates the printed double sheets of pressure sensitive paper into a receipt sheet and a journal sheet. The paper guide also operates to introduce the receipt sheet out of the casing through the opening and to guide the journal sheet in a predetermined direction within the casing with a front surface of the journal sheet exposed toward the opening. The paper support upwardly supports a rear surface of the journal sheet. Since the front surface of the journal sheet is exposed through the opening of the casing, a confirmation signature and/or correction signature can be handwritten on the front surface of the journal sheet.

8 Claims, 4 Drawing Sheets

PRINTER USING DOUBLE SHEETS OF PRESSURE SENSITIVE PAPER

BACKGROUND OF THE INVENTION

1. Field of the Invention

The present invention relates to a printer for electronic equipments such as POS (point of sales) terminals and electronic registers, and, in particular, to a printer using double sheets of pressure sensitive paper.

2. Description of the Background Art

FIGS. 1 and 2 show an example of an electronic register used as a banking terminal or teller terminal. The electronic register includes a cabinet 1, an input keyboard 2, a display 3 and a printer 4.

As shown in FIG. 2, the printer 4 accommodates a supply roll 16, a printing unit 7 and a collecting reel 18. The supply roll 16 feeds double sheets of pressure sensitive paper 6 to the printing unit 7, which carries out printing on the double sheets of pressure sensitive paper 6.

Double sheets of pressure sensitive paper 6 discharged from the printing unit 7 are separated into a lower journal sheet **6*a* and an upper receipt sheet 6*b* by a guide 17 formed at an inner end of a journal filter 12. The journal sheet 6*a* is wound around a collection roll 18. The receipt sheet 6*b* is discharged through a discharge slit 19 toward a position above the cabinet. The discharge slit 19 is provided at its forward edge with a cutter 11 for cutting off the receipt sheet 6*b***.

The illustrated printer of the prior art is designed to prevent the receipt sheet **6*b* separated by the guide 17 from rolling up inside the cabinet when the double sheets of pressure sensitive paper 6 are fed forward after the receipt sheet 6*b* is cut by the cutter 11. For this purpose, the discharge slit 19 has a small width, and the guide 17 is elongated downwardly. Therefore, the receipt sheet 6*b* fed upwardly through the discharge slit 19 is completely separated from the journal sheet 6*a* by the journal filter 12**.

In some cases, it is necessary to handwrite an confirmation signature and/or correction item on both the receipt and journal sheets **6*b* and 6*a* or only the journal sheet 6*a*. In the conventional printer, it is necessary to open a printer cover 5** every time the handwriting is required. This operation is troublesome.

In order to supply a new roll of the double sheets of pressure sensitive paper into the printer, such an operation is required that the leading edge portions of the double sheets of pressure sensitive paper are separated into the receipt sheet and journal sheet, and the separated receipt sheet is inserted from the inner side of the printer into the discharge slit 19. In the conventional printer, however, the discharge slit 19 has the small width, so that the inserting operation cannot be carried out smoothly and requires a long time.

SUMMARY OF THE INVENTION

Accordingly, it is an object of the invention to provide a printer, in which the confirmation signature and/or correction item can be facilely handwritten on receipt and journal sheets in an overlapped state or on the journal sheet.

Another object of the invention is to provide a printer, in which sheets can be facilely set in an intended service position when new double sheets of pressure sensitive paper are supplied into the printer.

A printer using double sheets of pressure sensitive paper according to the present invention includes a casing having an opening at its upper portion, a paper guide, a paper support and a paper collecting unit. The paper guide is disposed in the opening of the casing, and operates to separate the printed double sheets of pressure sensitive paper into a receipt sheet and a journal sheet. Thereafter, the receipt sheet is introduced out of the casing through the opening of the casing. The journal sheet is guided in a predetermined direction within the casing with its surface exposed toward the opening of the casing.

The paper support is disposed below the opening of the casing to support upwardly a rear surface of the journal sheet. The sheet collecting unit is disposed in the casing to collect the journal sheet which passed over the paper support.

According to the invention, the front surface of the journal sheet is exposed toward the opening of the casing. Therefore, a confirmation signature and/or correction item can be handwritten on the front surface of the journal sheet supported by the paper support. The receipt sheet and journal sheet can be overlapped each other in the opening of the casing. In this state, the confirmation signature and/or correction item can be handwritten on the receipt sheet and journal sheet in the overlapped state.

In a preferred embodiment, the paper guide includes a first guide for guiding the receipt sheet to a front edge of the opening, and a second guide for guiding the journal sheet onto the paper support, the second guide extending through a space between the opening of the casing and the paper support to the rear edge of the opening. Preferably, the paper guide is displaceably attached to the casing for changing the position of the first guide between a first position, in which the first guide is located near the front edge of the opening, and a second position, in which the first guide is located remote from the front edge of the opening. The displaceable paper guide facilitates the setting of the sheets of paper in a predetermined position when new double sheets of pressure sensitive paper are supplied into the printer. Specifically, by displacing the paper guide to the second position, a distance between the first guide and the front edge of the opening is increased, so that the receipt sheet can be facilely drawn out of the casing from the front edge of the opening.

The foregoing and other objects, features, aspects and advantages of the present invention will become more apparent from the following detailed description of the present invention when taken in conjunction with the accompanying drawings.

PREFERRED EMBODIMENT OF THE INVENTION

Figure 1:
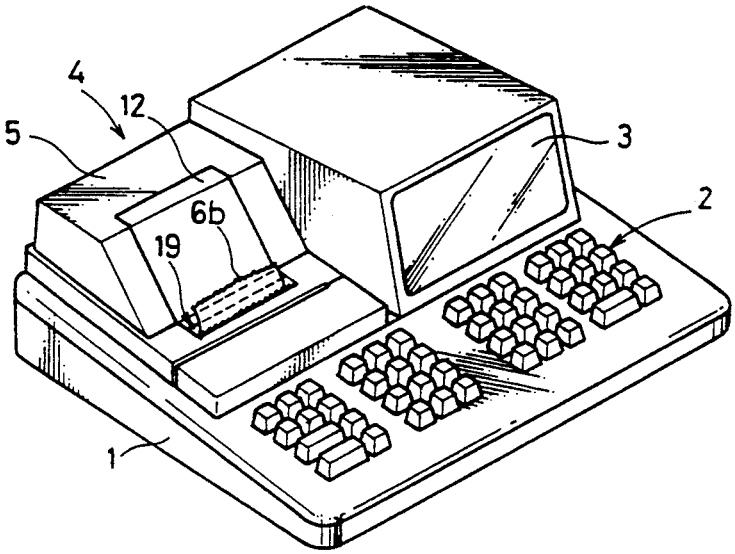
FIG.1 PRIOR ART
FIG. 1 is a perspective view of an electronic register in the prior art.
Figure 2:
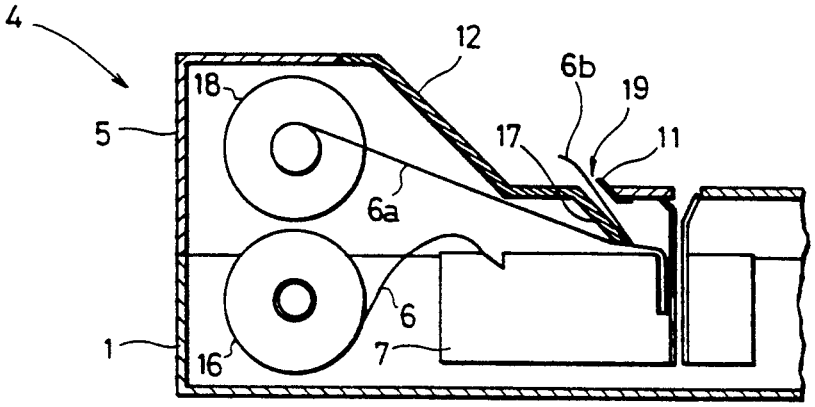
FIG. 2 PRIOR ART
FIG. 2 is a cross sectional view showing a printer of an electronic register in FIG. 1.
Figure 3:
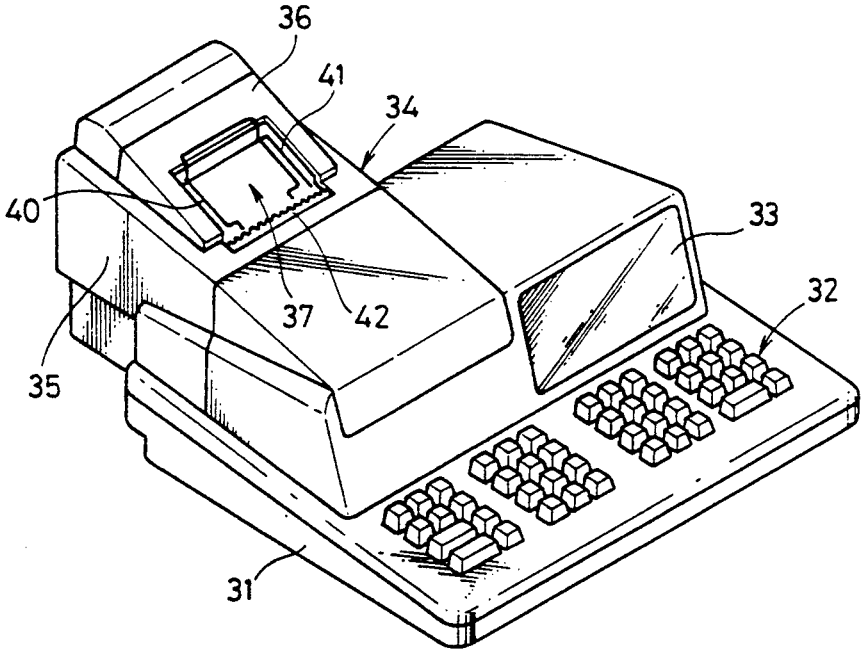
FIG. 3 is a perspective view of an electronic register employing an embodiment of the invention.

An electronic register shown in FIG. 3 includes a cabinet 31, an input keyboard 32, a display 33 and a printer 34.

Figure 4:
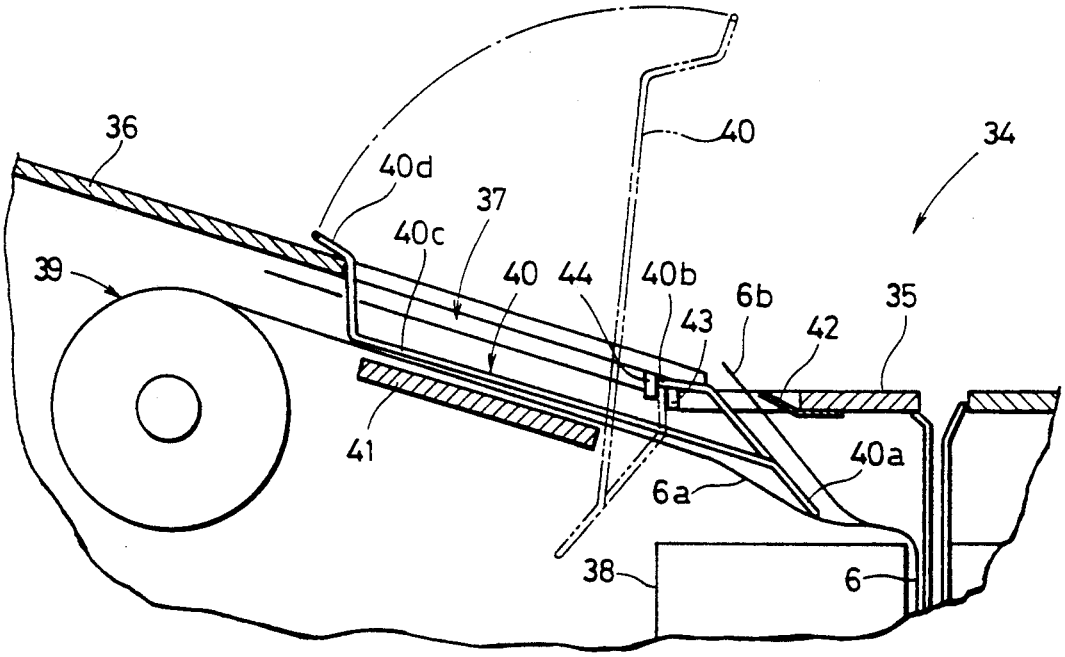
FIG. 4 is a cross sectional view showing a major part of an embodiment of the invention.

Referring to FIG. 4, the printer 34 includes a casing assembly provided at its upper portion with an opening 37. Specifically, opening 37 is formed between a casing 35 and a cover casing 36. In the casings 35 and 36 of the printer 34, there are disposed a printing unit 38, a collection reel 39, a paper guide 40 and a paper support 41.

The printing unit 38 carries out the printing on double sheets of pressure sensitive paper 6 fed from a supply roll (not shown). The paper guide 40 separates the printed double sheets of pressure sensitive paper 6 into a receipt sheet 6*b* and a journal sheet 6*a*. The receipt sheet 6*b* is fed out of the casing through the front edge of the opening 37. The journal sheet 6*a* is passed under the opening 37 of the casing, and is wound and collected around the collection reel 39. The width of the opening 37 of the casing is slightly larger than a width of double sheets of pressure sensitive paper 6.

Figure 5:
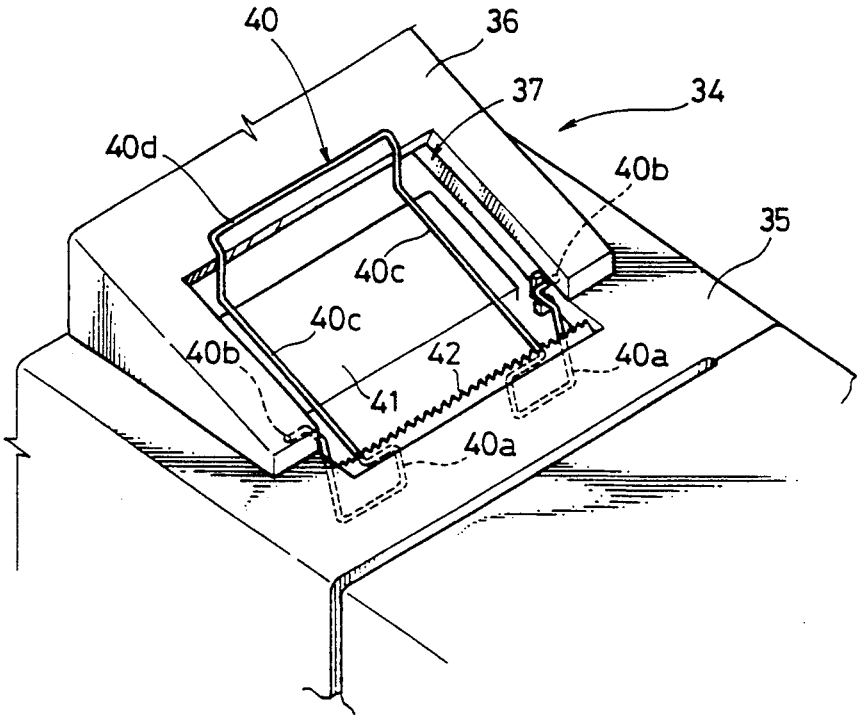
FIG. 5 is a perspective view of an embodiment of the invention.
Figure 6:
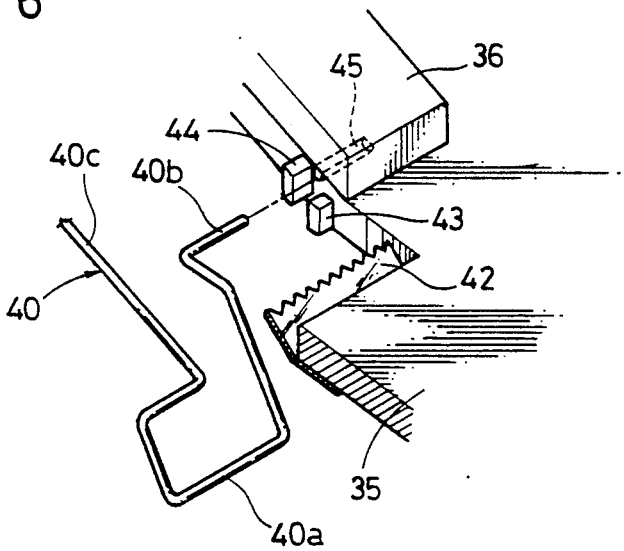
FIG. 6 is a perspective view showing an attaching structure of a paper guide.

Referring to FIGS. 4–6, the paper guide 40 in the illustrated embodiment is formed of a metal wire bent into a predetermined shape. The paper guide 40 includes first guides 40*a* for guiding the receipt sheet 6*b* to the front edge of opening 37, and second guides 40*c* which extend through a space between the opening 37 and the paper support 41 to the rear edge of opening 37 for guiding the journal sheet 6*a* onto the paper support 41. The double sheets of pressure sensitive paper 6 is separated by lower portions of the first guides 40*a* into the receipt sheet 6*b* and the journal sheet 6*a*. Upper end portions 4*b* of the first guides 40*a* are bent sideways.

Referring to FIG. 6, walls of the casing 35 defining side edges of the opening 37 are provided with holes 45. Upper portions of the holes 45 are covered with the cover casing 36. The upper end portions 40*b* of the first guides 40*a* of the paper guide 40 are rotatably fitted into the holes 45, respectively.

The second guides 40*c* of the paper guide 40 include an engagement portion 40*d*, which contacts the rear edge of the opening 37 and is laid on the outer surface of the cover casing 36. Referring to FIG. 5, a distance between a pair of parallel second guides 40*c* is slightly smaller than a width of the journal sheet 6*a* passing under the same. The paper support 41 supports upwardly a rear surface of the journal sheet 6*a* under the opening 37 of the casing. A front surface of the journal sheet 6*a* passing between the second guides 40*c* of the paper guide 40 and the paper support 41 is exposed toward the opening 37 of the casing.

Referring to FIG. 4, the paper guide 40 is attached to the casing for rotation around the upper end portions 40*b* of the first guides 40*a*. When the paper guide 40 is in the first position shown by solid line in the figure, the first guides 40*a* are located near the front edge of the opening 37. When the paper guide 40 is in the second position shown by phantom line in the figure, the first guides 40*a* are located remote from the front edge of the opening 37. The front edge of the opening 37 is provided with a cutter 42 for cutting off the receipt sheet 6*b*.

As shown in FIGS. 4 and 6, the side walls defining the side edges of the opening 37 are provided with first stoppers 43 for maintaining the paper guide 40 in the first position shown by the solid line in FIG. 4 and second stoppers 44 for maintaining the paper guide 40 in the second position shown by the phantom line. When the paper guide 40 is in the first position, the upper portions of the first guides 40*a* of the paper guide 40 are supported at their lower sides by the first stoppers 43 so that the paper guide 40 is prevented from rotating in the clockwise direction. The counterclockwise rotation of the paper guide 40 is prevented by the contact of the engagement portion 40*d* of the paper guide 40 with the rear edge of the opening 37.

When the paper guide 40 is to be displaced from the first position shown by the solid line in FIG. 4 to the second position shown by the phantom line, a pair of parallel second guides 40*c* are bent toward each other. Thereby, the upper portions of a pair of first guides 40*a* move toward each other and are disengaged from the first stoppers 43. In this disengaged state, the paper guide 40 is rotated clockwise to the position shown by the phantom line in FIG. 4, in which a force for bending second guides 40*c* is released. As a result, the upper portions of a pair of first guides 40*a* of paper guide 40 are pinched between the first stoppers 43 and the second stoppers 44, so that the paper guide 40 is fixed at the second position.

In the ordinary operation of the printer, the paper guide 40 is fixedly maintained in the first position shown by the solid line in FIG. 4. In this state, the front surface of the journal sheet 6*a* is exposed to the opening 37. Therefore, the confirmation signature and/or correction item can be handwritten on the surface of the journal sheet 6*a* located on the paper support 41. If the confirmation signature and/or correction item is to be written on the receipt sheet 6*b* and the journal sheet 6*a* in the overlapped state, this can be accomplished by laying the receipt sheet 6*b* on the journal sheet 6*a* in the opening 37.

When the paper guide 40 is maintained in the first position, a space between the first guides 40*a* of the paper guide 40 and the front edge of the opening 37 is small. When a new roll of the double sheets of pressure sensitive paper is to be attached in the printer, the paper guide 40 is located in the second position shown by the phantom line in FIG. 4. When the paper guide 40 is in the second position, the space between the first guides 40*a* and the front edge of the opening 37 is large. Therefore, the receipt sheet which is separated at the leading edge portion of the double sheets of pressure sensitive paper can be facilely drawn out of the casing through the front edge of the opening 37.

In the illustrated embodiment, the paper guide 40 is formed of the elastically deformable metal wire bent into the predetermined shape. Instead of the paper guide formed of the metal wire, the paper guide may be formed of a metal plate or molded plastic plate having an opening through which the surface of the journal sheet is exposed. Although the electronic register has been described as an example of the electronic equipment employing the printer of the invention, the present invention may be equivalently applied to banking terminals, other POS terminals or the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer using double sheets of pressure sensitive paper, said printer comprising:

a casing having an opening at its upper portion;

a paper guide disposed in said opening of said casing for separating the printed double sheets of pressure sensitive paper into a receipt sheet and a journal sheet, said paper guide being operable to introduce said receipt sheet out of said casing through said opening and to guide said journal sheet in a predetermined direction within said casing with a front surface of said journal sheet exposed toward said opening;

a paper support disposed under said casing for upwardly supporting a rear surface of said journal sheet; and paper collecting means disposed in said casing for collecting said journal sheet which passed over said paper support;

wherein said paper guide includes a first guide for guiding said receipt sheet to a front edge of said opening, and a second guide extending through a space between said opening and said paper support to a rear edge of said opening for guiding said journal sheet onto said paper support.

2. The printer according to claim 1, wherein said second guide has a width nearly equal to a width of said journal sheet, and said second guide has an opening through which a surface of said journal sheet located on said paper support is exposed.

3. The printer according to claim 2, wherein said paper guide is formed of a wire bent into a predetermined shape.

4. The printer according to claim 1, wherein said paper guide is attached to said casing for displacement between a first position in which said first guide is located near said front edge of said opening and a second position in which said first guide is located remote from said front edge of said opening.

5. The printer according to claim 4, wherein said printer further comprises a first stopper for maintaining said paper guide in said first position, and a second stopper for maintaining said paper guide in said second position.

6. The printer according to claim 4, wherein said paper guide is rotatably attached to said casing.

7. The printer according to claim 6, wherein said second guide of said paper guide includes an engagement portion which contacts said rear edge of said opening and is located on an outer surface of said casing.

8. The printer according to claim 1, wherein said printer further comprises a cutter attached to said front edge of said opening for cutting said receipt sheet.

* * * * *